United States Patent [19]

Matsuda et al.

[11] Patent Number: 4,924,560

[45] Date of Patent: May 15, 1990

[54] STRETCHABLE SLIDE FASTENER

[75] Inventors: Yoshio Matsuda, Toyama; Mitsuo Horikawa, Kurobe; Noritaka Tsubata, Uozu, all of Japan

[73] Assignee: Yoshida Kogyo K. K., Tokyo, Japan

[21] Appl. No.: 198,050

[22] Filed: May 24, 1988

[30] Foreign Application Priority Data

May 27, 1987 [JP] Japan ..... 62-130987

[51] Int. Cl.[5] ..... A44B 19/12

[52] U.S. Cl. ..... 24/392; 24/393; 66/190; 66/202; 139/384 B

[58] Field of Search ..... 24/391–395; 66/190–195; 139/384 B

[56] References Cited

U.S. PATENT DOCUMENTS

| | | | |
|---|---|---|---|
| 4,047,402 | 9/1977 | Matsuda et al. | 66/192 X |
| 4,067,208 | 1/1978 | Heimberger | 24/393 X |
| 4,492,098 | 1/1985 | Heimberger | 24/392 X |

FOREIGN PATENT DOCUMENTS

| | | |
|---|---|---|
| 0083072 | 6/1983 | European Pat. Off. . |
| 1025919 | 4/1953 | France . |
| 2323348 | 9/1976 | France . |
| . 262382 | 5/1951 | Japan . |
| 49-43451 | 11/1974 | Japan . |
| 1147660 | 4/1969 | United Kingdom . |
| 2024312 | 6/1979 | United Kingdom . |
| 2081757 | 8/1980 | United Kingdom . |
| 2127862 | 4/1984 | United Kingdom . |

*Primary Examiner*—Laurie K. Cranmer

*Attorney, Agent, or Firm*—Hill, Van Santen, Steadman & Simpson

[57] ABSTRACT

A stretchable slide fastener includes a pair of stretchable stringer tapes each having a longitudinal edge, and a row of coupling elements mounted on the longitudinal edge at a pitch. The pitch of the row of coupling elements is variable as the longitudinal edge is stretched. Each of the coupling elements includes a coupling head having a height, and at least the longitudinal edge being longitudinally stretchable by at least 10% such that the pitch of the coupling elements remains smaller than an interval which is twice the height of the coupling head.

10 Claims, 9 Drawing Sheets

STRETCHABLE SLIDE FASTENER

BACKGROUND OF THE INVENTION

1. Field of the Invention

The present invention relates to a longitudinally stretchable slide fastener for use on various stretchable articles such as sportswear, women's undergarments such as corsets, and the like.

2. Description of the Prior Art

Japanese Patent Publication No. 26-2382 and Japanese Utility Model Publication No. 49-43451, for example, disclose conventional stretchable slide fasteners. These known stretchable slide fasteners have stringer tapes which are stretchable warp-wise, and rows of coupling elements mounted on longitudinal edges of the stringer tapes, the rows of coupling elements being unstretchable longitudinally thereof.

Heretofore, the rows of coupling elements on the stretchable stringer tapes have been made unstretchable based on the long-believed design consideration that if stretched longitudinally, they would be split open or forced out of mutual meshing engagement. There have been no slide fasteners available so far with longitudinally stretchable rows of coupling elements.

Sportswear such as skiwear and skatewear, and women's supporting undergarments such as corsets are made mainly of stretchable fabric. Slide fasteners mounted on those stretchable garments have longitudinally unstretchable rows of coupling elements, as described above. Therefore, when the wearer of such a stretchable sportswear or undergarment does bending and stretching exercises, the portion of the wear where the slide fastener is mounted is felt as a stiff area by the wearer since it is not stretched, making the wearer feel uneasy, and also appears unsightly in comparison with the other stretched area.

SUMMARY OF THE INVENTION

In view of the aforesaid drawbacks of conventional slide fasteners, it is an object of the present invention to provide a stretchable slide fastener which is longitudinally stretchable as a whole including a pair of rows of coupling elements, is comparable to conventional slide fasteners with respect to functions, qualities, and appearance, and can be used on various garments such as sportswears and women's undergarments such as corsets for increased functional capabilities and comfortableness of those garments.

To achieve the above object, there is provided according to the present invention a stretchable slide fastener comprising a pair of stretchable stringer tapes each having a longitudinal edge, and a row of coupling elements mounted on the longitudinal edge at a pitch, the pitch of the row of coupling elements being variable with stretching of the longitudinal edge, each of the coupling elements including a coupling head having a height, at least the longitudinal edge being longitudinally stretchable by at least 10% such that the pitch of the coupling elements remains smaller than an interval which is twice the height of the coupling head.

When the slide fastener is longitudinally tensioned, it is longitudinally stretched. Since the longitudinal edge of the stringer tape on which the row of coupling elements is mounted is longitudinally stretchable by at least 10% such that the pitch of the coupling elements remains smaller than an interval which is twice the height of the coupling head, and the pitch of the row of coupling elements being variable with stretching of the longitudinal edge, the rows of coupling elements are also stretched to the extent that the rows of coupling elements will remain in intermeshing engagement. When the tension on the slide fastener is removed, the rows of coupling elements return to their original length.

The slide fastener of the invention is preferably used on stretchable garments such as sportswears and women's undergarments. When such a garment is stretched at its back or front area corresponding to the stomach and chest of the wearer, the slide fastener on the stretched area is also stretched. Therefore, the stretched area is not stiffened or less stiffened by the slide fastener, does not make the wearer feel uneasy, or makes the wearer feel more comfortable, and allows the garment to look well.

The stringer tape is of a knit or woven structure which is stretchable longitudinally or both longitudinally and transversely. The degree to which the longitudinal element-supporting edge is stretchable is controlled by suitably selecting the structure thereof, the stretchability of a core thread in or near the longitudinal edge, the stretchability of sewing threads by which the coupling elements are mounted on the tapes, and other considerations. Therefore, the slide fastener of the invention is not complex in structure and can be manufactured easily. The functions, qualities, and appearance of the slide fastener of the invention can freely be selected as with conventional slide fasteners.

A conventional woven stringer tape for a slide fastener is stretchable by about 1% under the load of 4 Kg, and a conventional warp-knit stringer tape for a slide fastener is stretchable by about 2 to 3% under the load of 4 Kg. The stringer tape of the invention which is stretchable by 10% or more can thus sufficiently be used on garments which should be stretched to allow the bending and stretching of wearers. The degree to which the stringer tape is stretchable is limited such that the pitch of the coupling elements is smaller than an interval which is twice the height of the coupling head. Therefore, when the stringer tape is stretched, the coupling elements are not forced out of mutual meshing engagement.

Another advantage of the stretchable rows of coupling elements is that they can smoothly be taken into and out of intermeshing engagement by a slider.

Many other advantages and features of the present invention will become manifest to those versed in the art upon making reference to the detailed description and the accompanying sheets of drawings in which preferred structural embodiments incorporating the principles of the present invention are shown by way of illustrative example

BRIEF DESCRIPTION OF THE DRAWINGS

FIG. 12(A) is a point diagram of chain stitches in the knit structure of the stringer tapes shown in FIG. 11;

FIG. 12(B) is a point diagram of tricot stitches in the knit structure of FIG. 11;

FIG. 12(C) is a point diagram of a laid-in weft thread in the knit structure of FIG. 11;

DETAILED DESCRIPTION

Figure 1:
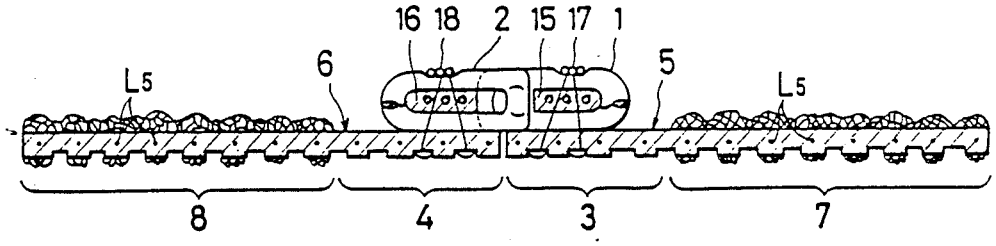
FIG. 1 is an enlarged transverse cross-sectional view of a slide fastener according to a first embodiment of the present invention.

FIGS. 1, 2, 3, and 4(A) through 4(E) illustrate a slide fastener according to a first embodiment of the present invention.

The slide fastener comprises a pair of stringer tapes 5, 6 supporting intermeshing rows of coupling elements 1, 2 securely mounted respectively on confronting inner longitudinal edges 3, 4 of the stringer tapes 5, 6. The stringer tapes 5, 6 including the inner longitudinal edges 3, 4 and outer longitudinal edges 7, 8, respectively, for attachment to a garment or the like are each composed of a warp-knit fabric which is mainly stretchable in the longitudinal direction indicated by the arrow 1.

As shown in FIGS. 3 and 4(B) through 4(E), each of the inner longitudinal edges 3, 4 comprises chain stitches L2 knit in a pattern of 2-2/2-0/0-0/0-2, tricot stitches L3 knit in a pattern of 2-2/2-4/2-2/2-0, weft threads L4 laid in a pattern of 4-4/0-0/4-4/8-8, and warp threads L5 laid in a pattern of 0-0/0-0/2-2/2-2. Designated at F are front needles and B back needles.

As illustrated in FIGS. 3, FIGS. 4(A), 4(C), 4(D), 4(E), each of the outer longitudinal edges 7, 8 comprises double chain stitches L1 knit in a pattern of 2-0/0-2/0-2/2-0, tricot stitches L3 knit in a pattern of 2-2/2-4/2-2/2-0, weft threads L4 laid in a pattern of 4-4/0-0/4-4/8-8, and warp threads L5 laid in a pattern of 0-0/0-0/2-2/2-2.

The laid-in warp threads L5 are composed of covered yarns of spandex, and stretchable to a range of 120 to 160% dependent on the amount of covering yarns used.

Threads 9, 10 making up the chain stitches L2 and running along the innermost sides of the inner longitudinal edges 3, 4, the laid-in weft threads L4, and threads 11, 12 making up the double chain stitches L1 and running along the outermost sides of the outer longitudinal edges 7, 8 are composed of reinforced threads which are thicker and stronger than the other threads in the stringer tapes 5, 6.

The threads 9, 10 and threads 13, 14 making up the chain stitches L2 and running adjacent to the threads 9, 10 are made of nylon.

The other threads than described above are in the form of processed bulky yarns of polyester.

Figure 2:
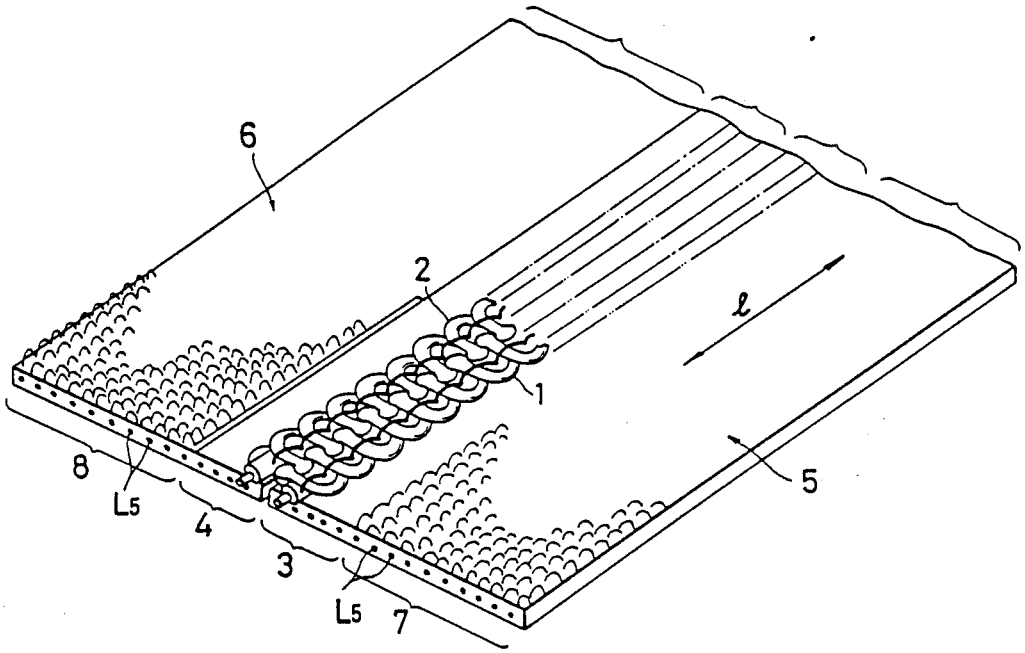
FIG. 2 is a fragmentary perspective view of the slide fastener shown in FIG. 1.
Figure 3:
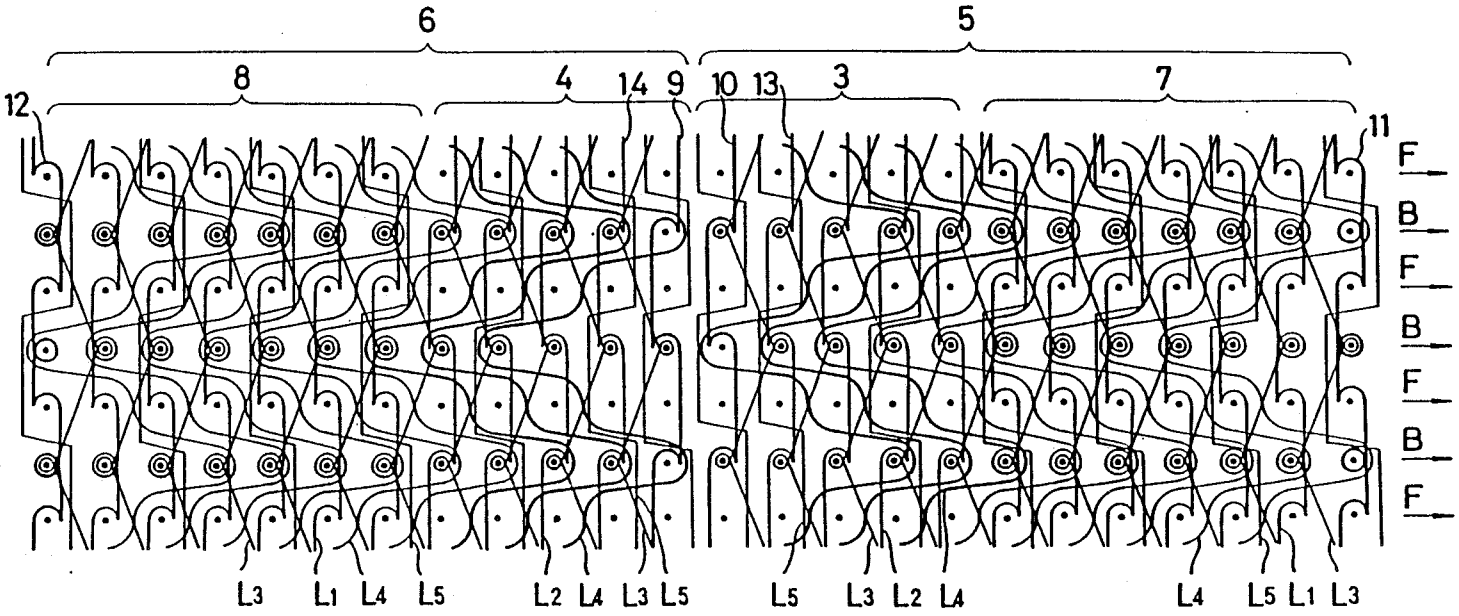
FIG. 3 is a point diagram of the stringer tapes of the slide fastener of FIG. 1.
Figure 4:
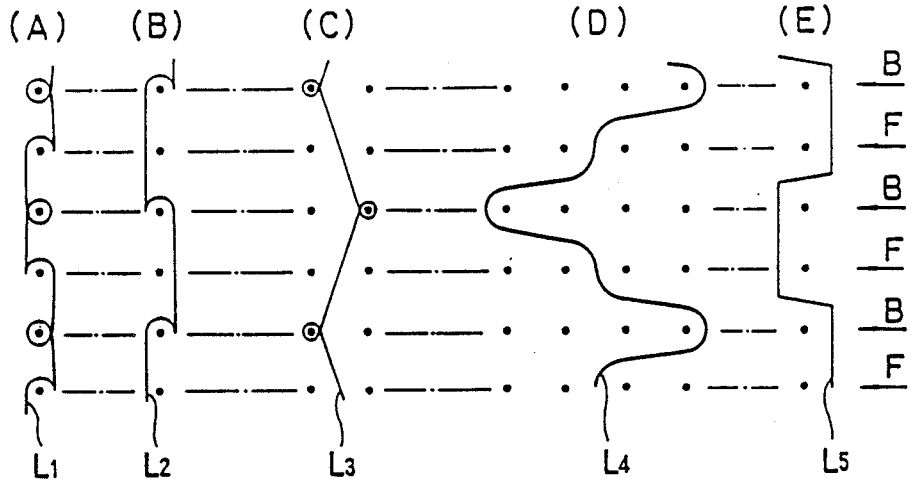
FIG. 4(A) is a point diagram of double chain stitches in the knit structure of the stringer tapes shown in FIG. 3.
FIG. 4(B) is a point diagram of chain stitches in the knit structure of FIG. 3.
FIG. 4(C) is a point diagram of tricot stitches in the knit structure of FIG. 3.
FIG. 4(D) is a point diagram of a laid-in weft thread in the knit structure of FIG. 3.
FIG. 4(E) is a point diagram of a laid-in warp thread in the knit structure of FIG. 3.

As shown in FIGS. 1 and 2, the coupling elements 1, 2 are in the form of helically coiled coupling elements of synthetic resin. The coupling elements 1, 2 may however be zigzag coupling elements. Core threads 15, 16 disposed in and extending along the rows of coupling elements 1, 2 comprise covered yarns of spandex, and are stretchable to a range of 120 to 160% dependent on the amount of covering yarns used.

The coupling elements 1, 2 are sewn to the inner longitudinal edges 3, 4 by means of sewing threads including upper threads 17, 18. At least the upper threads 17, 18 are in the form of processed bulky yarns of polyester.

The warp threads L5 in the form of covered yarns of spandex are laid in along every other wales. They may be laid in along all wales. The warp threads L5 may be uncovered yarns of spandex.

The weft threads L4 may be composed of multifilaments of polyester in order to stiffen the stringer tapes 5, 6.

The chain stitches L2, the tricot stitches L3, the double chain stitches L1, the covering yarns for the covered yarns of spandex of the warp threads L5, the covering yarns for the covered yarns of spandex of the core threads 15, 16, and sewing threads by which the coupling elements 1, 2 are stitched to the stringer tapes 5, 6 serve as members for limiting the warp-wise stretching of the stringer tapes 5, 6 which is allowed by the laid-in warp threads L5.

The processed bulky yarns of polyester referred to above may be replaced with knit stitches of a material which will match the material of the garment to which the slide fastener is attached.

Figure 5:
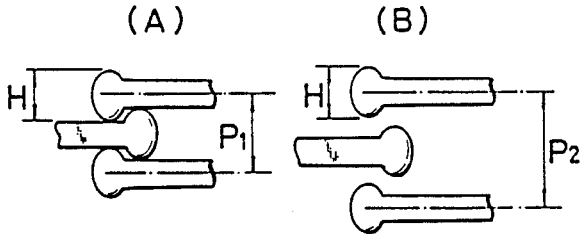
FIG. 5(A) is a fragmentary view of coupling elements of the slide fastener before it is stretched.
FIG. 5(B) is a fragmentary view of coupling elements of the slide fastener when it is stretched.
Figure 6:
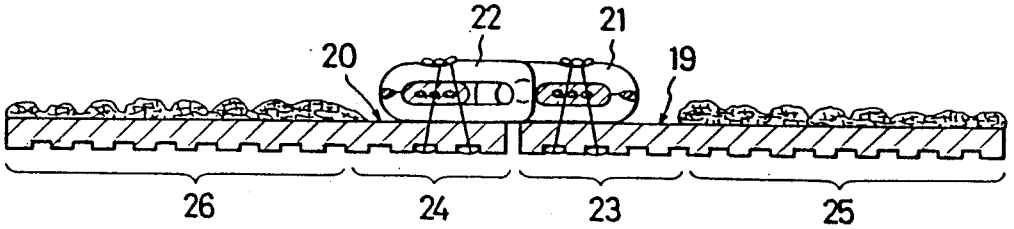
FIG. 6 is an enlarged transverse cross-sectional view of a slide fastener according to a second embodiment of the present invention.
Figure 7:
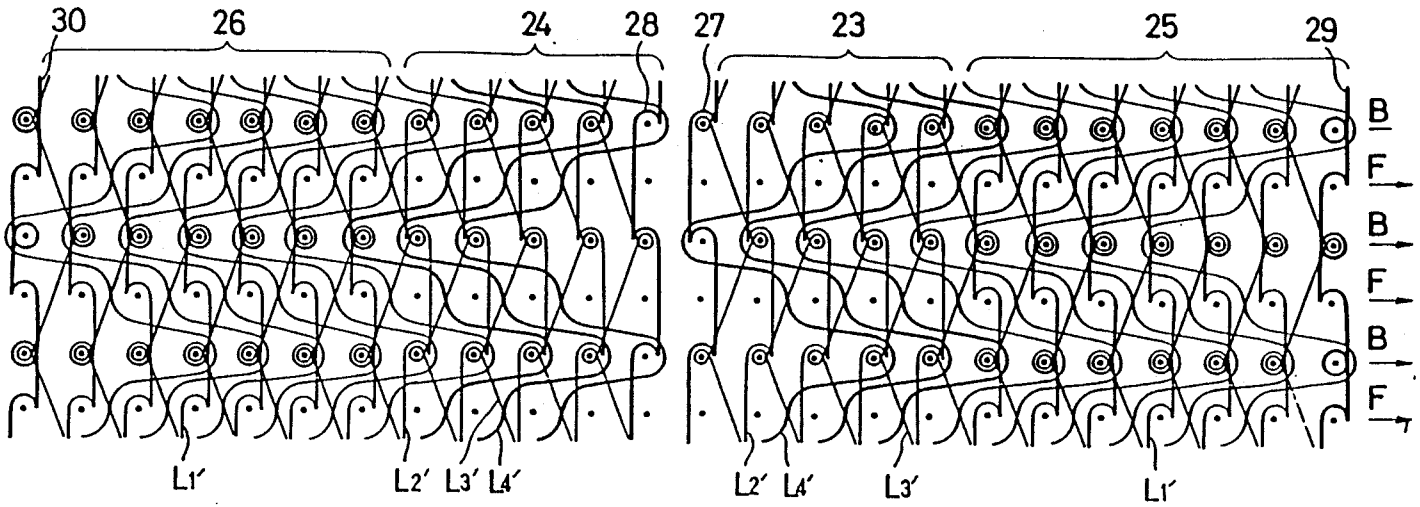
FIG. 7 is a point diagram of the stringer tapes of the slide fastener of FIG. 6.
Figure 8:
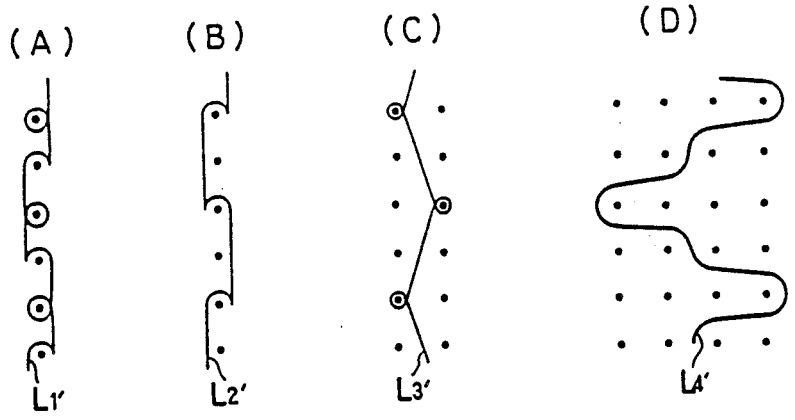
FIG. 8(A) is a point diagram of double chain stitches in the knit structure of the stringer tapes shown in FIG. 7.
FIG. 8(B) is a point diagram of chain stitches in the knit structure of FIG. 7.
FIG. 8(C) is a point diagram of tricot stitches in the knit structure of FIG. 7.
FIG. 8(D) is a point diagram of a laid-in weft thread in the knit structure of FIG. 7.

The manner in which the intermeshing coupling elements 1, 2 behave when the slide fastener is longitudinally stretched will be described below. When the slide fastener is longitudinally stretched, the row of coupling elements each having a coupling head projecting on each side of its leg is also longitudinally stretched from the condition of FIG. 5(A) to the condition of FIG. 5(B) until the pitch between two adjacent coupling elements increases from P1 to P2. The intermeshing rows of coupling elements are split open or forced out of meshing engagement when the pitch P2 between two adjacent coupling elements of one row is equalized to the interval which is twice the height H of the coupling head of a coupling element of the other row which is positioned between the two adjacent coupling elements.

Therefore, the degree to which the slide fastener can be stretched longitudinally is expressed as:

$$\frac{P2 - P1}{P1} \times 80\% \text{ (safety factor) provided that}$$

$$P2 < 2H \text{ where } H \text{ is a height of the coupling head.}$$

provided that P2<2H where H is a height of the coupling head.

The above formula also applies to slide fasteners having coupling elements with their coupling heads projecting on only one side of the legs of the coupling elements, which are typically made of metal.

An experiment indicated that a slide fastener having coupling elements with their coupling heads projecting on each side of the legs thereof can be stretched to about 46%, whereas a slide fastener having coupling elements with their coupling heads projecting on one side of the legs thereof can be stretched to about 19%. It is known that it is sufficient for skiwear fabrics or the like to be stretched about 10% at minimum.

As a consequence, the tape structure of the slide fastener is controlled by the chain stitches L2, the tricot stitches L3, the covering yarns, and the sewing threads, as described above, such that the degree to which the slide fastener is allowed to be longitudinally stretched by the laid-in warp threads L5 should be 10% or more, and the pitch of the coupling elements as stretched remains smaller than the interval which is twice the height of the coupling heads.

The sewing threads are in the form of double chain stitches in sewing the coupling elements 1, 2 to the stringer tapes 5, 6. Since the sewing threads thus formed and the core threads 15, 16 are stretchable, they can be stretched with the stringer tapes 5, 6 while varying their pitches.

Inasmuch as the threads 9, 10, 13, 14 forming the chain stitches in the inner longitudinal edges 3, 4 are made of nylon, the fastener stringers as manufactured which have been curved relatively largely with the rows of coupling elements on the convex sides are relatively moderately or less curved when heated in a dyeing process because the nylon threads are more heat-shrinkable than the polyester threads.

FIGS. 6, 7, 8(A) through (D) show a slide fastener according to a second embodiment of the present invention. The slide fastener has a pair of stringer tapes 19, 20 which are stretchable both longitudinally and transversely.

The stringer tapes 19, 20 support intermeshing rows of coupling elements 21, 22 securely mounted respectively on confronting inner longitudinal edges 23, 24 thereof. The stringer tapes 19, 20 including the inner longitudinal edges 23, 24 and outer longitudinal edges 25, 26, respectively, for attachment to a garment or the like are each composed of a warp-knit fabric which is stretchable in the longitudinal and transverse directions as described above.

As shown in FIGS. 7 and 8(B) through 8(D), each of the inner longitudinal edges 23, 24 comprises chain stitches L2' knit in a pattern of 2-2/2-0/0-0/0-2, tricot stitches L3' knit in a pattern of 2-2/2-4/2-2/2-0, and weft threads L4' laid in a pattern of 4-4/0-0/4-4/8-8. Designated at F are front needles and B back needles.

As illustrated in FIGS. 7, FIGS. 8(A), 8(C), 8(D), each of the outer longitudinal edges 25, 26 comprises double chain stitches L1' knit in a pattern of 2-0/0-2/0-2/2-0, tricot stitches L3' knit in a pattern of 2-2/2-4/2-2/2-0, and weft threads L4' laid in a pattern of 4-4/0-0/4-4/8-8.

The tricot stitches L3' may be replaced with two needle switches knit in a pattern of 0-0/0-4/4-4/4-0.

The tricot switches L5' are composed of covered yarns of spandex, and stretchable to a range of 120 to 160% dependent on the amount of covering yarns used.

Threads 27, 28 making up the chain stitches L2' and running along the innermost sides of the inner longitudinal edges 23, 24, the laid-in weft threads L4', and threads 29, 30 making up the double chain stitches L1' and running along the outermost sides of the outer longitudinal edges 25, 26 are composed of reinforced threads which are stronger than the other threads in the stringer tapes 19, 20. The threads 27, 28 in particular are made of nylon, whereas the other threads than the threads described above are in the form of processed bulky yarns of spandex.

The coupling elements 21, 22 have the same core threads and are sewn to the stringer tapes 19, 20 by the same sewing threads as those of the first embodiment.

Since the stringer tapes 19, 20 are stretchable warpwise and weft-wise, i.e., both longitudinally and transversely, the degree to which they can be stretched can be controlled in the same manner as described above with reference to the first embodiment.

Figure 9:
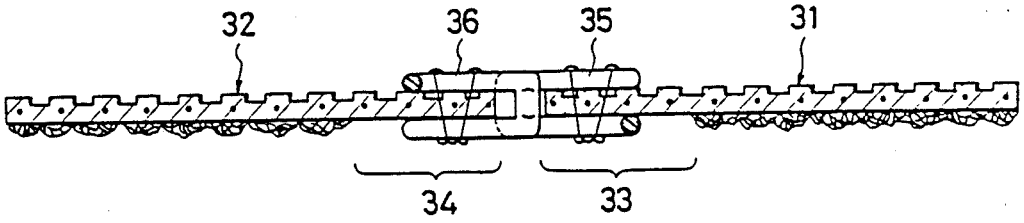
FIG. 9 is an enlarged transverse cross-sectional view of a slide fastener according to a third embodiment of the present invention.
Figure 10:
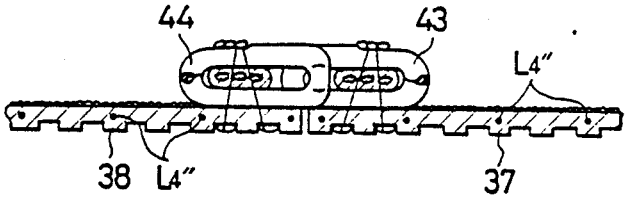
FIG. 10 is an enlarged transverse cross-sectional view of a slide fastener according to a fourth embodiment of the present invention.
Figure 11:
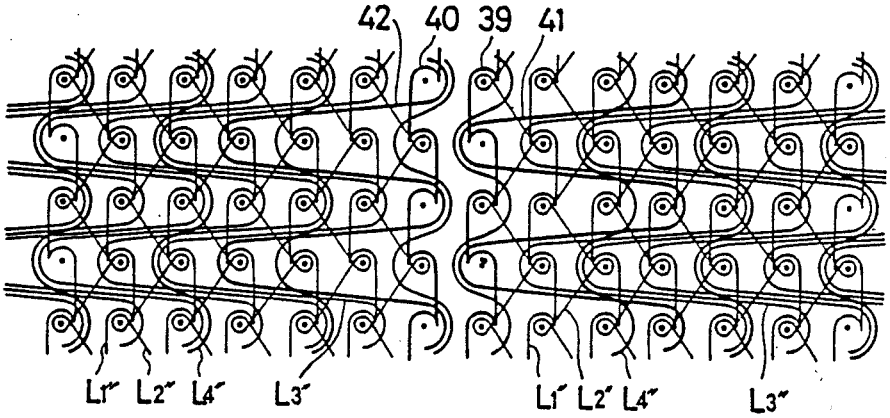
FIG. 11 is a point diagram of the stringer tapes of the slide fastener of FIG. 10.

FIG. 9 shows a slide fastener according to a third embodiment in which rows of zigzag coupling elements 43, 44 are securely sewn to inner longitudinal edges 33, 34 of stringer tapes 31, 32 which are of the same knit structure as that of the first embodiment shown in FIGS. 3 and 4(A) through 4(E).

FIGS. 10, 11 and 12(A) through 12(E) illustrates a slide fastener according to a fourth embodiment, the slide fastener being particularly suitable for use on thin garments. The slide fastener includes a pair of stringer tapes 37, 38 each comprising chain stitches L1" knit in a pattern of 1-0/0-1, tricot stitches L2" knit in a pattern of 1-2/1-0, weft threads L3" laid in a pattern of 0-0/4-4, and warp threads L4" laid in a pattern of 0-0/1-1.

The laid-in warp threads L4" are composed of covered yarns of spandex. Threads 39, 40 making up the chain stitches L1" and running along the innermost sides of inner longitudinal edges of the stringer tapes which support coupling elements are composed of processed bulky yarns of nylon 6 or nylon 6/6. The other threads are composed of processed bulky yarns of polyester.

Threads 41, 42 serving as the laid-in weft weft threads L3" and running adjacent to the threads 39, 40 are reinforced yarns which are stronger than the other threads.

The degree to which the laid-in warp threads L4" are stretchable is controlled in the same manner as described above in the first embodiment. Coupling elements 43, 44 mounted on the stringer tapes 37, 38 have the same core threads and are sewn to the stringer tapes 37, 38 by the same sewing threads as those of the first embodiment.

The weft threads L3" may be composed of multifilaments of polyester.

Figure 12:
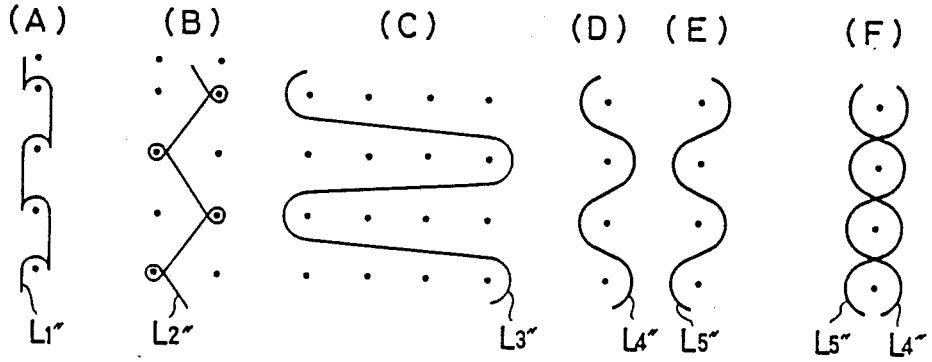
FIGS. 12 (D), 12(E), and 12(F) are point diagrams of different laid-in warp threads in the knit structure of FIG. 11.

The laid-in warp threads L4" may be replaced with warp threads 5" laid in a pattern of 1-1/0-0 as shown in FIG. 12(E) or a combination of laid-in warp threads L4", L5" as shown in FIG. 12(F).

Figure 13:
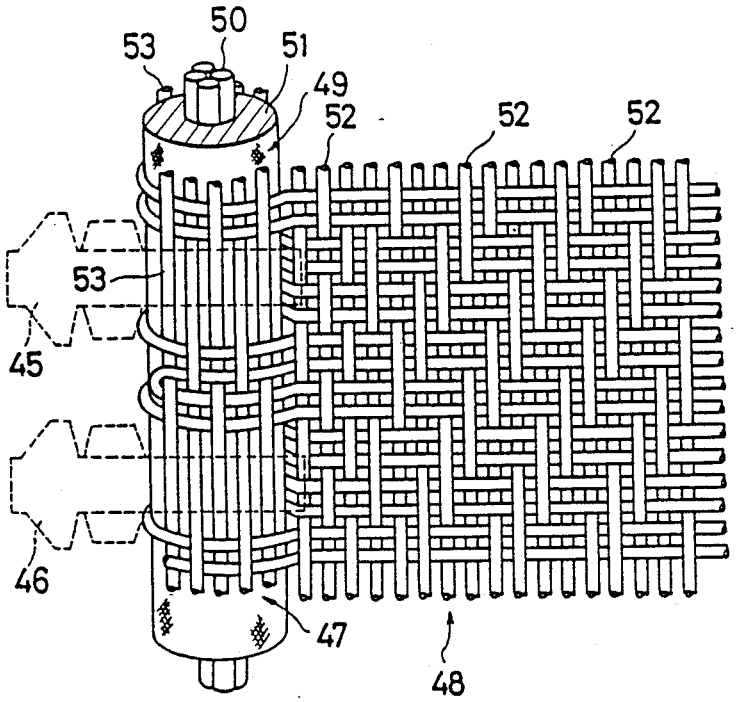
FIG. 13 is an enlarged fragmentary view of a stringer tape of a slide fastener according to a fifth embodiment of the present invention.

FIG. 13 shows a slide fastener according to a fifth embodiment which has a woven stringer tape 48 including a longitudinal edge 47 on which double-sided coupling elements 45, 46 of metal or synthetic resin are mounted. The longitudinal edge 47 includes an elongate core member 49 integrally woven by a hollow weave.

The core member 49 comprises a plurality of covered yarns 50 of spandex which are covered with a cord 51 knit of processed bulky yarns of polyester.

The stringer tape 48 is woven of warp and weft threads composed of processed bulky yarns of polyester, and include transversely spaced warp threads 52 composed of processed bulky yarns of spandex. The longitudinal edge 47 also includes warp threads 53 in the form of multifilaments of nylon which lie in outer positions on the core member 49. The warp threads 53 serve the same purpose as that of the chain stitches 9, 10, 13, 14 of the first embodiment.

The stringer tape 48 may be of any desired woven structure which matches the structure of the fabric of a garment to which it is attached. The stringer tape 48 can however be made stiffer by employing weft threads in the form of multifilaments of polyester.

In the embodiment shown in FIG. 13, the stringer tape 48 is of a woven arrangement under reduced tension so as to be relatively stretchable because of the covered yarns of spandex. The degree to which the stringer tape 48 is stretchable warp-wise is controlled by the amount of covering yarns used for the covered yarns of spandex and the density at which the stringer tape 48 is woven.

Figure 14:
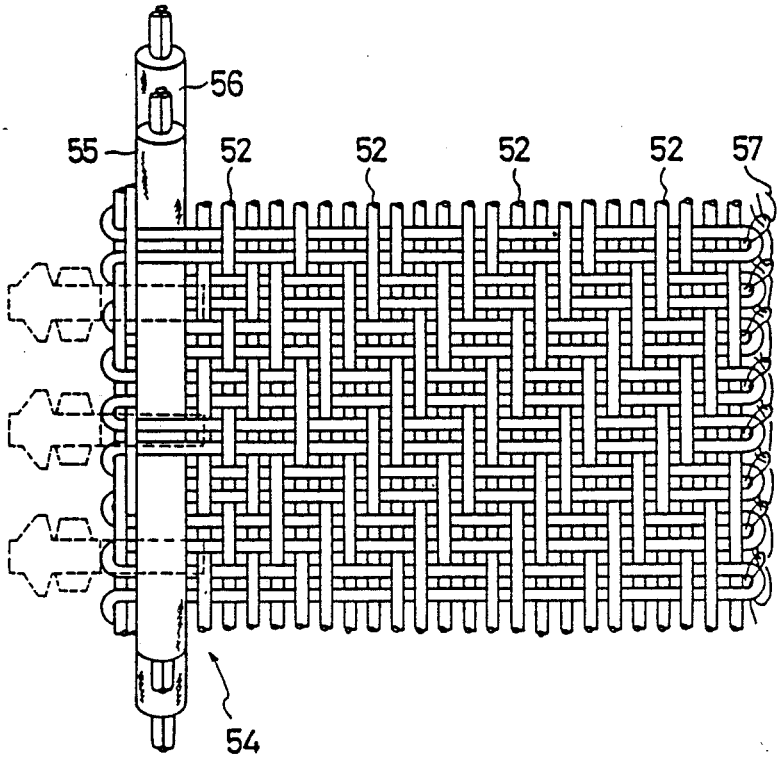
FIG. 14 is an enlarged fragmentary view of a stringer tape of a slide fastener according to a sixth embodiment of the invention.
Figure 15:
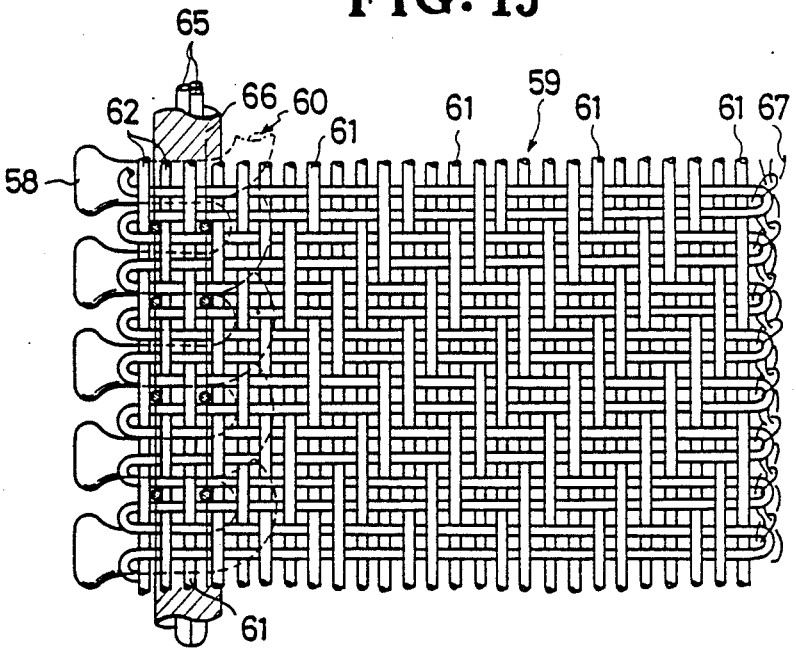
FIG. 15 is an enlarged fragmentary view of a stringer of a slide fastener according to a seventh embodiment of the invention.

A sixth embodiment shown in FIG. 14 differs from the fifth embodiment of FIG. 15 in that core members 55, 56 are woven integrally in a longitudinal element-supporting edge 54 by a bead-weaving structure. The other longitudinal edge opposite to the element-supporting edge 54 includes a selvedge yarn 57.

Figure 16:
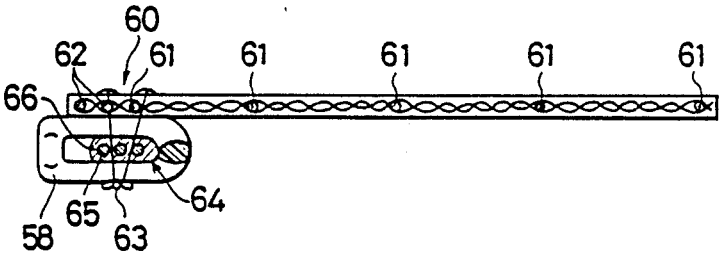
FIG. 16 is a transverse cross-sectional view of the stringer shown in FIG. 15.

FIGS. 15 through 16 illustrate a slide fastener according to a seventh embodiment. A row of helically coiled coupling elements 58, which is identical to the rows of coupling elements 1, 2 of the first embodiment, is securely stitched to a longitudinal edge 60 of a stringer tape 59. The stringer tape 59 is of a woven structure having warp and weft threads composed of processed bulky yarns of polyester and transversely spaced warp threads 61 composed of covered yarns of spandex. The longitudinal edge 60 includes woven warp threads 62 in the form of multifilaments of nylon.

The row of coupling elements 58 is sewn by sewing threads including lower threads 63 composed of processed bulky yarns of polyester. A core thread 64 extends in and through the row of coupling elements 58 and is composed of covered yarns 65 of spandex that are covered with a covering layer 66 of processed bulky yarns of polyester, as with the first embodiment. The other longitudinal edge opposite to the element-supporting edge 60 includes a selvedge yarn 67.

In the embodiments shown in FIGS. 13, 14, and 15, the degree to which the stringer tape is stretchable warp-wise is controlled to the same extent as that in which the degree to which the stringer tape of the first embodiment is stretchable.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A stretchable slide fastener comprising a pair of stringer tapes stitched in a manner so as to be stretchable, each having a longitudinal edge, and a row of coupling elements mounted on said longitudinal edge at a pitch, said pitch of the row of coupling elements being variable with stretching of said longitudinal edge, each of said coupling elements including a coupling head having a height, each of said stringer tapes including thread means for controlling the stretching of at least said longitudinal edge to such an extent that said longitudinal edge is longitudinally stretchable by at least 10% and the pitch of the coupling elements remains smaller than an interval which is twice the height of the coupling head when said longitudinal edge is longitudinally stretched, said controlling thread means including covered yarns of spandex composed of spandex yarns allowing the stretching of said longitudinally edge, and covering yarns covering said spandex yarns and limiting the stretching of said longitudinal edge.

2. A stretchable slide fastener according to claim 1, wherein each of said stringer tapes is of a knit structure.

3. A stretchable slide fastener according to claim 1, wherein said stringer tapes are stretchable both longitudinally and transversely.

4. A stretchable slide fastener according to claim 1, wherein each of said stringer tapes is of a woven structure.

5. A stretchable slide fastener according to claim 4, wherein said longitudinal edge includes a core member woven thereinto and composed of covered yarns of spandex covered with a knit cord.

6. A stretchable slide fastener according to claim 5, wherein said longitudinal edge includes warp threads composed of multifilaments of nylon and lying on said core member.

7. A stretchable slide fastener according to claim 4, wherein said row of coupling elements has a core thread extending therethrough and composed of covered yarns of spandex covered with a layer.

8. A stretchable slide fastener comprising a pair of stringer tapes stitched in a manner so as to be stretchable, each having a longitudinal edge, and a row of coupling elements mounted on said longitudinal edge at a pitch, said pitch of the row of coupling elements being variable with stretching of said longitudinal edge, each of said coupling elements including a coupling head having a height, each of said stringer tapes including thread means for controlling the stretching of at least said longitudinal edge to such an extent that said longitudinal edge is longitudinally stretchable by at least 10% and the pitch of the coupling elements remains smaller than an interval which is twice the height of the coupling head when said longitudinal edge is longitudinally stretched, said controlling thread means including chain stitches, tricot stitches, double chain stitches and covering yarns for covered yarns of spandex of a core thread.

9. A stretchable slide fastener according to claim 8, wherein said chain stitches are knitted in a pattern of 2-2/2-0/0-0/0-2 said tricot stitches are knit in a pattern of 2-2/2-4/2-2/2-0, and said double chain stitches are knit in a pattern of 2-2/0-2/0-2/2-0.

10. A stretchable slide fastener according to claim 8, said controlling thread means comprising chain stitches, double chain stitches, two needle stitches knit in a pattern of 0-0/0-4/4-4/4-0.

* * * * *